United States Patent [19]

Maurer

[11] 3,978,330

[45] Aug. 31, 1976

[54] BATTERY HAND LAMP

[76] Inventor: Paul Peter Maurer, Luzernerstrasse 27, CH-8903 Birmensdorf, Switzerland

[22] Filed: Sept. 11, 1974

[21] Appl. No.: 504,895

[30] Foreign Application Priority Data

Sept. 17, 1973 Switzerland ..... 13327/73

[52] U.S. Cl. ..... 240/10.6 R; 240/10.66; 240/51.11 R

[51] Int. Cl.[2] ..... F21L 11/00

[58] Field of Search ..... 240/10.6 R, 10.6 CH, 240/10.61, 10.63, 10.65, 10.66, 11.4 R, 26, 51.11, 51.12, 10.64

[56] References Cited

UNITED STATES PATENTS

| | | | |
|---|---|---|---|
| 2,760,053 | 8/1956 | Choisser | 240/11.4 R |
| 2,874,270 | 2/1959 | Douglass et al. | 240/11.4 R |
| 3,219,811 | 11/1965 | Young | 240/10.66 |
| 3,809,882 | 5/1974 | Wetmore | 240/10.66 |

*Primary Examiner*—Russell E. Adams, Jr.
*Attorney, Agent, or Firm*—Griffin, Branigan and Butler

[57] ABSTRACT

A battery hand lamp for use where high luminosity is desirable and where a damp or wet environment or water is encountered, as is the case on boats, in fighting fires or in speleology or the like. The battery hand lamp consists of two units, namely a supply unit and a lamp unit. A fluorescent tube is housed in a protection tube provided with a socket fitting into a corresponding opening of the supply unit. A seal is provided at the socket to prevent the entry of water to the electric connectors connecting the lamp unit with the supply unit. One connector has the form of slide contact springs and the other connector has the form of slide contact rings cooperating with said slide contact springs. This permits one to insert the lamp unit into the supply unit by pushing the lamp unit in and at the same time turning it. In a similar way the lamp unit may be detached from the supply unit by pulling and turning the lamp unit out of the supply unit. In this way the friction force excerted by the seal at the socket is easily surmounted and the lamp unit may be positioned in any desired angular position with respect to the supply unit. To permit the lamp to float on water hollow spaces in the lamp unit and in the supply unit may be so dimensioned that the specific weight of the lamp is less than one.

4 Claims, 15 Drawing Figures

BATTERY HAND LAMP

BACKGROUND OF THE INVENTION

The invention concerns battery hand lamps comprising a supply unit and a lamp unit.

Prior art battery and hand lamps have the disadvantage of a relatively low luminous efficiency because in an incandescent lamp only a small percentage of the supplied electric energy is transformed into light. Substantially better is the luminous efficiency on fluorescent tubes. If impulses of very high luminosity are desired they can be obtained by electric flash tubes. Fluorescent tubes as well as flash tubes require relatively high operating voltages. Therefore, a converter device must be used to convert relatively low battery voltage into a relatively high voltage as is required by incandescent tubes or flash tubes.

When high operating voltages are used, it is absolutely necessary to protect the necessary electric or electronic parts against moisture. Up to the present time this has not been possible on battery hand lamps or only at very high expense, so that such lamps did not survive in the market.

SUMMARY OF THE INVENTION

An object of the present invention is to provide an improved battery hand lamp.

A further object of the invention is to provide a battery hand lamp of improved luminous efficiency.

A further object of the invention is to provide a battery hand lamp of high luminous efficiency for use in damp or wet environments.

It is also an object of the invention to provide a hand lamp having an easily releasable and waterproof electric connection between a supply unit and a lamp unit.

According to the present invention these and other objects are met by a novel battery hand lamp comprising a supply unit and a lamp unit, wherein the lamp unit comprises a socket fitting into a corresponding opening in the supply unit, a seal being provided between said socket and a wall of said opening. Electric connectors are provided on said socket and in said opening, said electric connectors having the form of slide contact rings or segments and slide contacts cooperating with each other and permitting the mounting of the lamp unit in the supply unit in different angular positions.

Further the hollow spaces in the lamp unit and the supply unit are so dimensioned, that the battery hand lamp has a specific weight of less than one and hence is capable of floating. This makes it possible to use the battery hand lamp also on boats without the danger that it will sink when it falls overboard. Further, the battery hand lamp may also be used for example in emergency situations to mark a certain place in a lake.

BRIEF DESCRIPTION OF THE DRAWINGS

The above mentioned and other objects and features of the invention will be more fully understood from the following detailed description thereof when read in conjunction with the drawings in which:

FIG. 9 shows a cover lid seen from the side opposite to the side from which FIG. 8 is seen and with a contact spring inserted.

Figure 1:
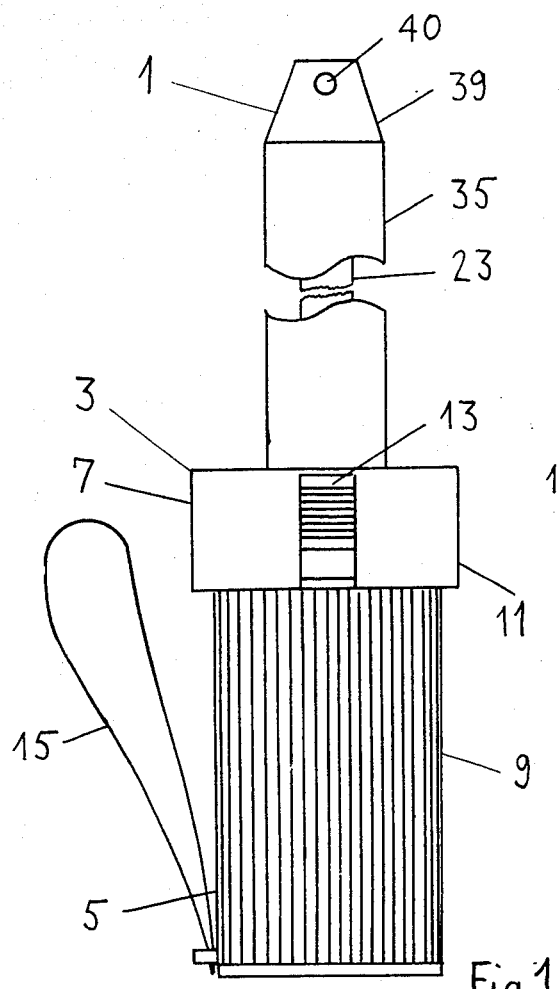
FIG. 1 shows a front view of a battery hand lamp of this invention.
Figure 2:
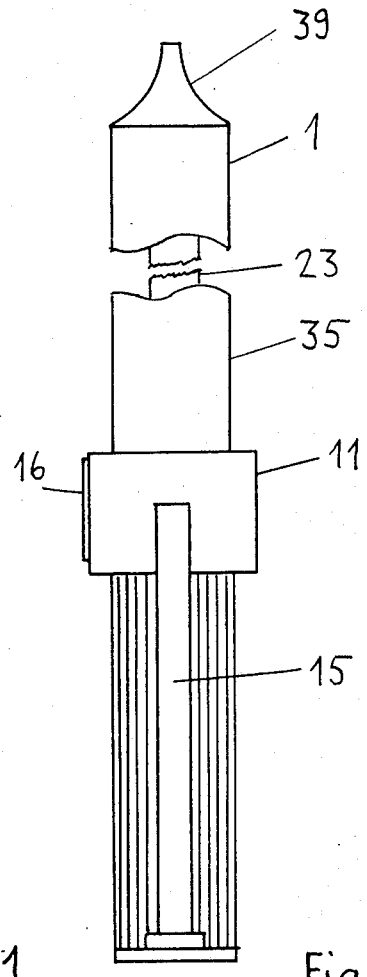
FIG. 2 shows a side view of the battery hand lamp of FIG. 1.
Figure 3:
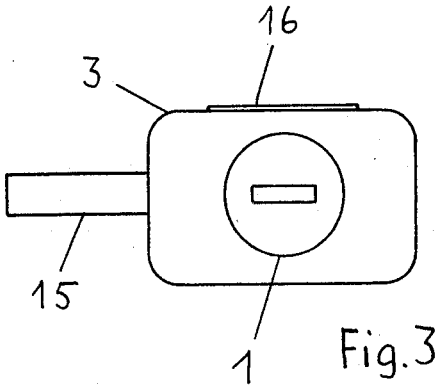
FIG. 3 shows the battery hand lamp seen from the top.
Figure 4:
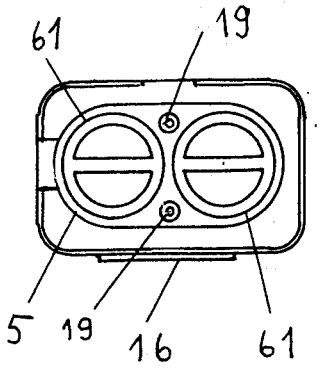
FIG. 4 shows the battery hand lamp seen from the bottom.

As FIGS. 1 and 2 show in particular the battery hand lamp consists substantially of a lamp unit 1 and a supply unit 3. The supply unit 3 comprises two portions, namely the battery portion 5 containing the batteries 17 and the convertor portion 7 supplying the lamp unit 1 with a suitable voltage. In the embodiment shown a fluorescent tube 23 is provided as a lamp. However, it would also be possible to use other light sources in which case, however, the supply unit must be designed to have the necessary electrical characteristics required by the particular light source.

At the converter housing 11 a switch 13 is provided. The construction of the switch will be described later on. A safety sling 15 consisting of a plastic tape or the like is mounted at the battery housing 9 to insure the hand lamp against involuntary droping.

As FIG. 2 shows, a permanent magnet 15 is moulded in one side into the converter housing 11 to permit fastening magnetically the battery hand lamp to ferromagnetic objects.

In the embodiment of the invention shown the battery housing 9 may receive four batteries 17. It would also be possible to design the battery housing to receive another number of batteries. The batteries may be usual batteries which are replaced after discharge. However, the use of rechargeable batteries, e.g., nickel-cadmium-batteries, will be of advantage. For rechargeing of the batteries the battery housing 9 is provided with connector pins 19. Inside the battery housing the connector pins 19 are switched in such a way that connection of the connector pins 19 to a suitable current supply will permit charging the batteries 17 without opening the battery housing 9. Suitable current sources, i.e., charging devices, are already well known for this purpose and therefore must not be described.

Figure 5:
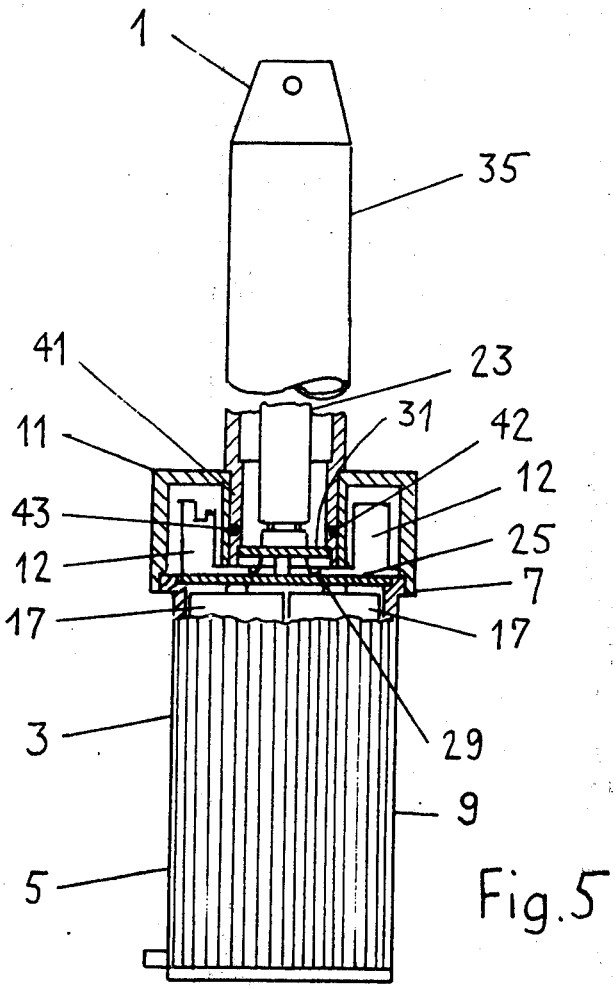
FIG. 5 is a partial sectional view of the battery hand lamp according to FIG. 1.
Figure 6:
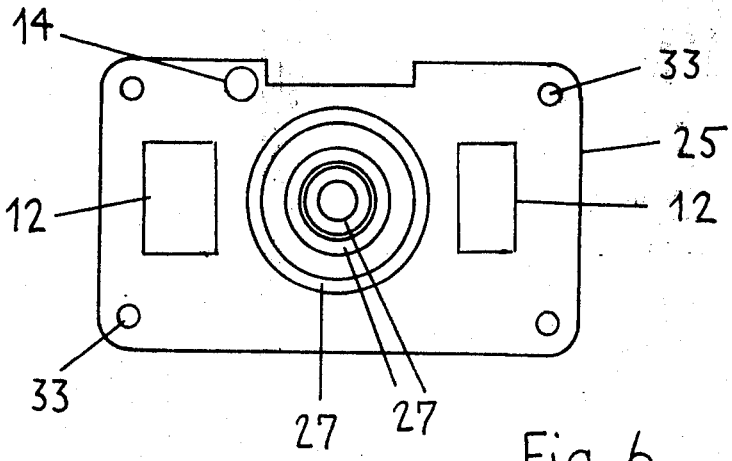
FIG. 6 is a top view of the mounting plate with the slide contact rings, the mounting plate being shown approximately twice as large as on FIG. 5.
Figure 12:
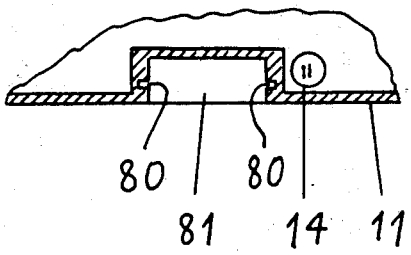

The converter housing 11 contains electronics 12 for increasing the low voltage of the batteries 17 to a sufficiently high voltage or tension to operate the fluorescent tube 23 or eventually another light source. The mounting plate 25 separates the battery portion 5 from the converter portion 7. On the side facing the lamp unit 1 the mounting plate contains three concentric slide contact rings or segments 27. On the slide contact ring 27 three correspondingly spaced slide contacts, 29 preferable springs stamped from sheet metal and mounted on the lamp socket 31 may contact the slide contact rings when the lamp unit 1 is inserted into the supply unit 3. It is also possible to provide a different number of slide contact rings 27 and slide contact springs 29 if another number is required. On the same side as the slide contact rings 27 the components of electronics 12 of the converter portion 7 are located on the mounting plate 25, as is indicated in FIG. 5. The same is true for the contact 14. This contact may be a contact of a so-called reed switch 13 (FIG. 12).

It will be evident that in manufacturing, the described construction of the battery hand lamp makes it possible to assemble the battery hand lamp from two building units. This substantially facilitates manufacturing. For example, the converter portion 7 may be assembled on the mounting plate 25, then be inserted together with the mounting plate on the battery housing 9, and finally be connected to the battery housing 9. Advantageously, the connection of the converter portion takes place by small protrusions (not shown) projecting from the interior of the battery housing 9 through openings 33 of the mounting plate 25. These protrusions may then be partly melted by heating them with a soldering iron or the like. In this way a solid connection is obtained between the battery housing 9 and the mounting plate 25. The battery portion 5, together with the mounting plate 25 connected thereon and carrying the electronics 12 of the converter, is connected to the converter housing 11 as follows: converter housing 11, with its opening pointing upward, is filled with liquid plastic foam, whereupon the battery portion 5, together with the converter electronics 12, is inserted, in a position, reversed to that shown in FIG. 5, into the converter housing 11. The liquid plastic foam will then enclose the components of the electronics 12, and the adjacent parts of the battery housing 9 and the converter housing 11 will be unreleasably and watertightly together as soon as the liquid plastic foam solidifies connected.

Figure 13:
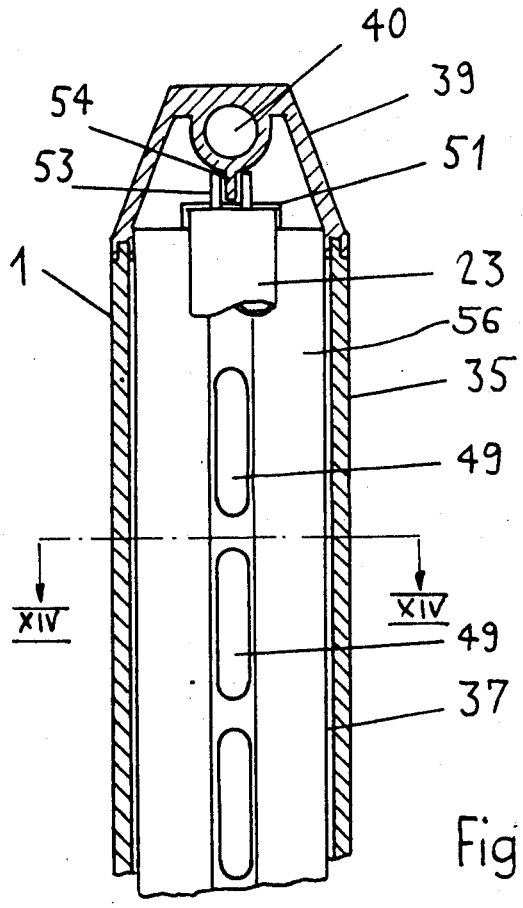
FIG. 13 shows a section through the lamp unit with the protection tube, the reflector and the fluorescent tube.
Figure 14:
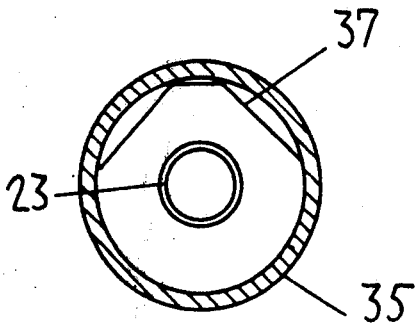
FIG. 14 shows a section XIV—XIV through the lamp unit according to FIG. 13.

The lamp unit, as shown particularily in FIGS. 5, 13 and 14, consists substantially of a fluorescent tube 23, a transparent protection tube 35 and a reflector 37. As termination of one end the protection tube 35 carries a cap 39 consisting preferably of the same material, e.g., transparent plastic, as the protection tube 35. The cap 39 is connected with the protection tube 35 by a suitable adhesive forming a watertight connection. Preferably, the cap 39 is provided with an opening 40, on which the battery hand lamp may easily be suspended. It will also be possible to insert into this opening 40, e.g., a hook of rubber or another material to facilitate hanging up of the battery hand lamp.

The other end of the protection tube 35 receives the lamp socket 31 which is preferable unreleaseably connected with the protection tube 35 after mounting of the fluorescent tube 23. Also this tube socket may consist of the same material as the protection tube 35. Because fluorescent tubes have a long life, it is possible and also adivisable to mount the fluorescent tube unreleasably in the protection tue 35, so that the fluorescent tube may normally not be removed by the user. This practically prevents a breaking of the fluorescent tube 23 by unsuitable handling. The protection tube 35 is relatively inexpensive, so that in case of a defect it is economically feasible to exchange the whole lamp unit.

It should also be noted that the exchangeability of the lamp unit makes it possible to use the same battery hand lamp with different lamp units having for example different colors. It may again be mentioned that fluorescent tubes have an exceptionally high luminous efficiency.

In the region of the converter portion 7 the protection tube 35 is provided with a pluggable socket in form of a cylindrical portion 41 having a somewhat smaller diameter than the diameter of the protection tube 35. An O-ring 43 is contained in a groove 42 of the socket 41. The O-ring 43 provides a seal against the penetration of water into the lamp unit 1 and the supply unit 3.

If the lamp unit 1 has to be inserted into the cylindrical opening 44 of the supply unit 3 or has to be removed therefrom some effort is necessary because of the friction caused by the O-ring 43. Nevertheless, it will still be possible to combine or separate easily the units 1 and 3 because the lamp unit 1 can be rotated during insertion or removal. This is made possible by the special construction of the electric connectors between the lamp unit 1 and the supply unit 3, where not a usual plug connection is provided, but rather slide contact rings 27 and slide contact springs 29. Accordingly, in plugging in the lamp unit it will be of no importance in which angular position the lamp unit 1 is in respect to the supply unit 3. The correct electric connection between the units 1 and 3 will be assured in every angular position.

The reflector 37 is best seen from FIG. 13. It consists of a suitable reflective material, preferably a thin aluminum sheet. It is possible to use also other metallic materials. A possible form is seen from FIG. 14. Depending on the use, the reflector may also have another form. The reflector 37 may also be provided with slots 49, so that the light emitting towards the back of the fluorescent tube may emit from the rear of the lamp. Normally no practical use is made of this light. However, according to the invention the light emitted at the rear of the lamp may issue in a different colour. This can be obtained by a suitable staining of the rear part of the protection tube 35 or for example, by inserting a colored transparent foil (not shown) behind the reflector 37.

Figure 15:
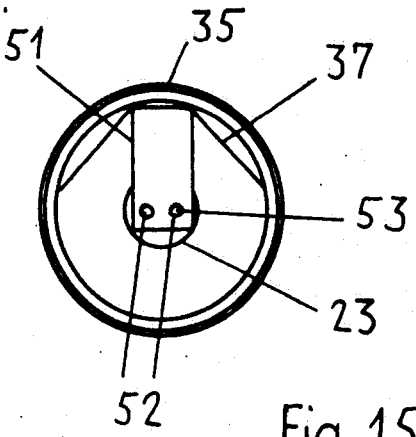
FIG. 15 shows a view of the lamp unit seen from the top, but without cap.

As FIGS. 14 and 15 show, the reflector 37 is at one end provided with a lug 51 having two openings 52 into which terminals 53 of the fluorescent tube 23 may enter. In this way the position of the reflector 37 in the protection tube 35 is determined and the reflector 37 may also serve as electric conductor to apply a voltage to one of the two electrodes of the fluorescent tube 23. A bridge 54 in the interior of the cap 39 retains the fluorescent tube 23 at one end coaxially in the interior of the protection tube 35, whereas the other end of the fluorescent tube is held by the lamp socket 31, which by means of slide contact springs 29 provides for the necessary electric connections to the supply unit 3. One of the three slide contact springs 29 is connected to the reflector 37 serving as electric conductor, but this is not shown in detail in the drawing. Instead of a current conducting reflector 37 it would also be possible to provide a wire as electric conductor to the terminals 53.

The lamp unit 1 has a relatively large hollow room 56 between the fluorescent tube 23 and the protection tube 35. It is advisable to dimension the hollow room 56 together with the other hollow rooms in such a way that the battery hand lamp has a specific weight of less than one so that it can float on water. Thus sinking of the lamp is prevented when, for example, on use in a boat it falls overboard. In order to use the battery hand lamp on boats or below water, not only a watertight connection must be provided between lamp unit 1 and supply unit 3, but also no water should enter into the supply portion 3 or the electric part of the switch 13. This is of particular importance because the battery hand lamp has a relatively high operating voltage.

Figure 7:
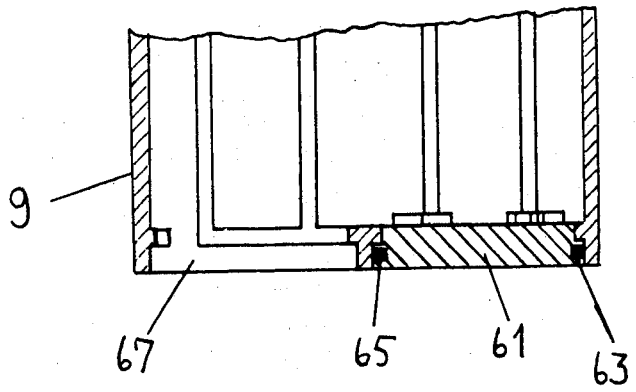
FIG. 7 is a sectional view, also in a larger scale than in FIG. 1, through the lower part of the housing of the battery hand lamp according to FIG. 1, there being one cover lid inserted and the other one not shown.
Figure 8:
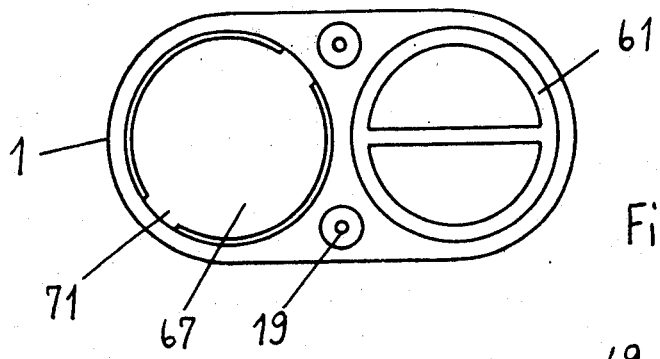
FIG. 8 is a view from the bottom with an inserted cover lid and a cover lid not shown as in FIG. 7.
Figure 9:
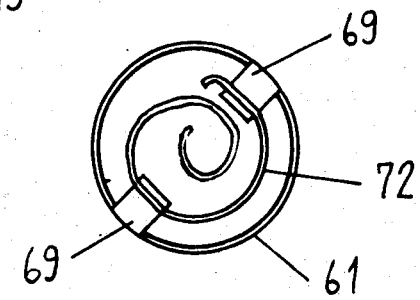
Figure 10:
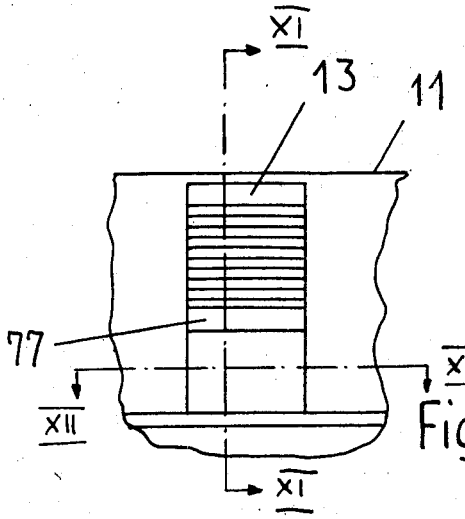
FIGS. 10 to 12 show the construction of a switch, FIG. 10 representing a top view, FIG. 11 a section XI—XI, and FIG. 12 a setion XII—XII of FIG. 10.

As FIGS. 7 to 9 show, the battery housing lid 61 is provided at the border with a groove 63 to receive the O-ring 65. The battery housing 9 is provided with openings 67 for the battery housing lid 61. These lids 61 have lateral lugs 69 fitting into slots 71 of the battery housing 9. The lugs 69 and the slots 71 form a so-called bayonet joint, so that the battery housing can be closed by inserting and turning the battery housing lid. The O-ring 65 provides water-tight closure. A spiral spring 72 mounted on the lugs 69 acts as contact to the battery and provides also the necessary contact pressure at the other battery contacts. The spiral spring 72 is connected by flexible wire (not shown) to the printed circuit of the mounting plate 25.

Figure 11:
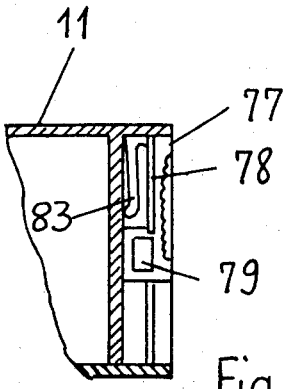

The switch 13 consists substantially of a slide 77. In FIG. 11 the slide is shown undissected. It contains a permanent magnet 79 by which a contact, e.g., a reed contact 14, located in the converter housing 11 may be operated when the slide is moved from one end position (off) to the other end position (on) in the recess 81 of the converter housing 11. The slide 77 has on both sides a rib 78 (in FIG. 11 only one rib is visible) engaging into a groove 80 (FIG. 12). A plastic spring 83 being preferably integral with the slide 77 holds the slide 77 in the respective end position. It is also possible to provide means to permit the plastic spring 83 to register in the respective end position, so that the slide 77 will not move when vibrations or the like are present.

Most parts of the battery hand lamp consist advantageously of plastic, e.g., the battery housing 9, the converter housing 11 and the protection tube 35.

While the embodiment described refers to a battery hand lamp comprising a fluorescent tube 23, it is obvious to the man skilled in the art that the lamp unit may contain instead of a fluorescent tube 23 a flash tube or any other light source. Naturally the electronics 12 of the converter portion 7 would have to be in each case adapted to the particular electric characteristics of the light source. Therefore, the invention permits also the application of other light sources then the light source used on the described embodiment.

What I claim is:

1. A battery hand lamp comprising:

a supply unit defining an opening therein with an opening wall;

a lamp unit including a plug for force fitting into said opening in the supply unit, but having an unlimited freedom of angular movement within said opening; and a seal means for forming a watertight seal between said plug and said opening wall when said plug is in said opening to thereby prevent leakage therebetween;

said supply unit including electrical connectors inside said opening and said lamp unit including electrical connectors on said plug for contacting said supply-unit electrical connectors, to conduct electrical energy from said supply unit to said lamp unit, ones of said electrical connectors having the form of rings and the other being slide contacts for contacting said rings and permitting the mounting of the lamp unit in the supply unit in different angular positions, while providing electrical contact between said electrical connectors in any of said angular positions;

said lamp unit further comprising a fluorescent tube in electrical contact with said connectors and a transparent protection tube for containing said fluorescent tube and a metallic reflector located in the protection tube, said reflector serving as an electric conductor between one contact and the fluorescent tube.

2. A battery hand lamp as claimed in claim 1, wherein said reflector has openings permitting a part of the light to radiate to the back.

3. A battery hand lamp as claimed in claim 2, comprising a colored foil between the reflector and the protection tube.

4. A battery hand lamp as claimed in claim 2, wherein in the region behind the reflector the protection tube is colored.

* * * * *